United States Patent [19]

Colmar

[11] 4,334,372

[45] Jun. 15, 1982

[54] MOVABLE WEB VARIABLE EXHIBITOR

[76] Inventor: Jack E. Colmar, 106 Marchington Cir., Scarborough, Ontario, Canada

[21] Appl. No.: 259,902

[22] Filed: May 4, 1981

Related U.S. Application Data

[63] Continuation-in-part of Ser. No. 127,890, Mar. 6, 1980, abandoned.

[51] Int. Cl.[3] ..... G09F 3/18

[52] U.S. Cl. ..... 40/16.2; 40/5; 40/511

[58] Field of Search ..... 40/16.4, 508, 510, 511, 40/529

[56] References Cited

U.S. PATENT DOCUMENTS

| | | | |
|---|---|---|---|
| 535,635 | 3/1895 | Stone | 40/508 |
| 1,527,382 | 2/1925 | Snyder | 40/529 |
| 2,543,731 | 2/1951 | Rosenfeld | 40/511 |
| 3,016,638 | 1/1962 | Singer | 40/5 |

FOREIGN PATENT DOCUMENTS

| | | | |
|---|---|---|---|
| 6360 | 2/1879 | Fed. Rep. of Germany | 40/529 |
| 30572 | 9/1909 | Sweden | 40/529 |
| 103349 | 2/1924 | Switzerland | 40/529 |

*Primary Examiner*—Robert Peshock
*Assistant Examiner*—Wenceslao J. Contreras
*Attorney, Agent, or Firm*—Fetherstonhaugh & Co.

[57] ABSTRACT

A device for displaying price and like information wherein the figures to be displayed are contained on a series of panels folded into two stacks so that the top panel in each stack combines to make a display area and display one complete figure. The outside edge of each stack of folded panels are retained in a frame to dispose the top panel of each stack in the said display area. The outside edges of each stack are retained in the frame as aforesaid in opposed channels and a user can, by depressing the panel on the top of a stack actuate the edge of the depressed panel out of its channel, turn it over and insert it into the other channel whereby to change the panels on the top of each stack and, at the same time, change information conveyed by the top panels.

1 Claim, 5 Drawing Figures

MOVABLE WEB VARIABLE EXHIBITOR

The application is a continuation-in-part of Application No. 127,890 filed on Mar. 6, 1980, now abandoned.

This invention relates to a device for displaying information wherein the information displayed can be changed without removing the display panels of the device. A common application of the invention is the display of pricing information on a retailer's shelf.

Price display devices that comprise a body formed with channels to receive and hold the edges of flexible price cards are commonly used in grocery and other retailing. The store operator has a supply of price cards that he slides in and out of the channels to display any price he requires. The devices have been extensively used at least for the extent of the memory of most persons in the retail trade.

The changing of the price cards is a tedious and cumbersome procedure especially in cases where prices fluctuate continuously as they do in the grocery business to accommodate specials, weekly fluctuations in supply prices and other factors.

This invention takes an entirely different approach to the problem of changing prices and provides a structure with which it is possible to vary prices by the simple manipulation of a stack of price panels in the housing. It is not necessary to take out and replace cards to change price.

A display device according to this invention comprises a strip of flexible sheet material formed with a series of transverse folds to divide it into panels of equal size, the panels being arranged in two stacks, the top panel of each stack beind adjacent panels joined at the fold line between them; a housing for said panels having two retainer channels the outside edge of one of said stacks being contained by one retainer channel and the outside edge of the other of said stacks being contained by the other of said channels; said housing having a support bar between said retainer channels underlying said fold line between the top panel of each of said stacks; said retainer channels being spaced to hold the top panels of each stack with said fold line between the top panel of each of said stacks against said support whereby to present the top panels to open view; said support bar having a height greater than the edge thickness of the stack of panels beneath it and greater than the depth of said retainer channels; the plane of the upper edge of the retainer channels being spaced above the upper edge of said support bar whereby to relax the panels in said stacks and urge the fold line between the top panel of each of the stacks against said support bar and provide for the manual manipulation of the top panel in one stack to move said fold line between the top panel of both stacks from the support a distance to pull the top panel of the other stack from its retainer channel, said top panel so removed from one retainer channel being insertable in the other retainer channel to display two different panels of said strip as top panels to open view; said panels having display materials thereon, the display materials being visible when they are top panels in said stacks in said housing and in open view as aforesaid. The invention will be clearly understood after reference to the following detailed specification read in conjunction with the drawings.

Figure 1:
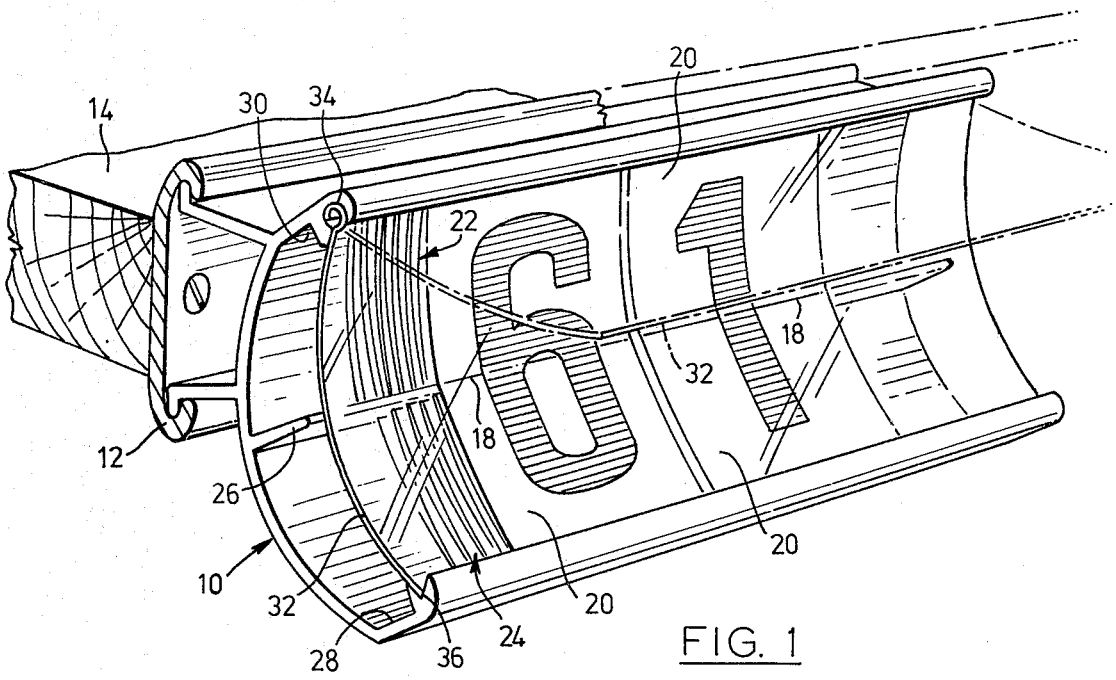
FIG. 1 is a perspective illustration of a display device according to this invention showing two stacks of panels mounted therein to form a two-digit display.

The drawings illustrate a display device commonly used on grocery and retail store shelves for indicating the price of articles on the shelf. The device has a housing generally indicated by the numeral 10 that is made from an extruded plastics material and that slides or clips into a bracket 12 on the shelf 14. In use a display strip showing a price is mounted into the housing as will be explained and serves to inform the public of the price of the articles on the shelf at the location of the device.

The display strip generally indicated by numeral 16 is made of a light weight cardboard or sheet material and is formed with a series of transverse folds as at 18 to form it into a series of panels 20.

In use and when mounted in the housing the panels 20 are stacked in two piles generally indicated by the numerals 22 and 24 on each side of a fold line 18 between the two panels 20 that are open and which together carry the display material to be read by a user of the display device.

Figure 3:
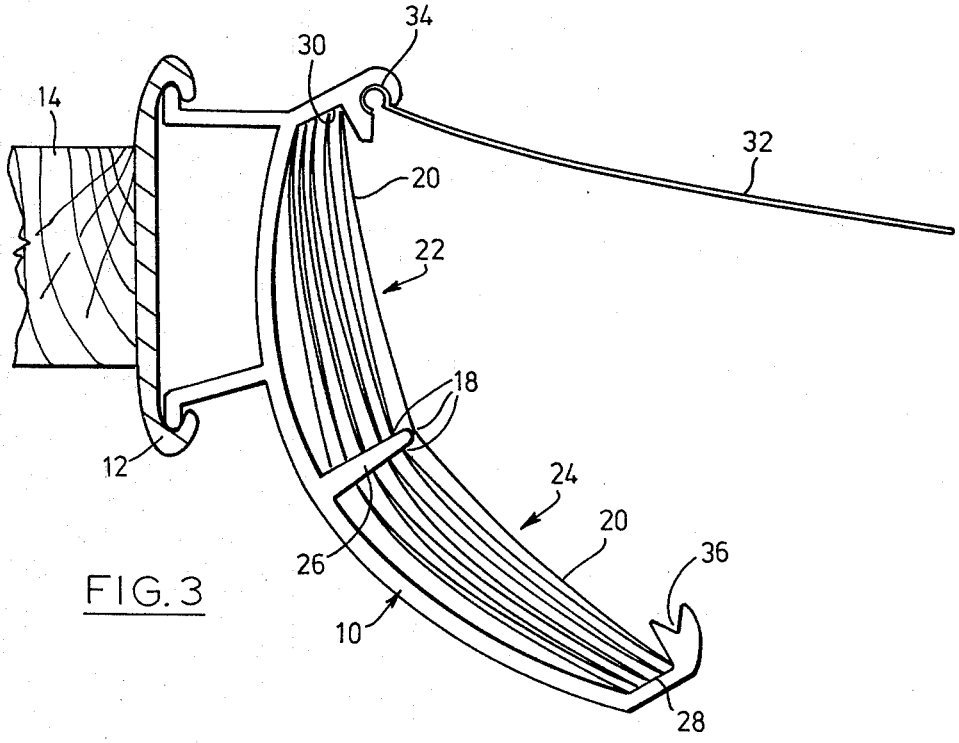
FIG. 3 is an illustration from the end showing the disposition of the stacks of panels in the holder.
Figure 2:
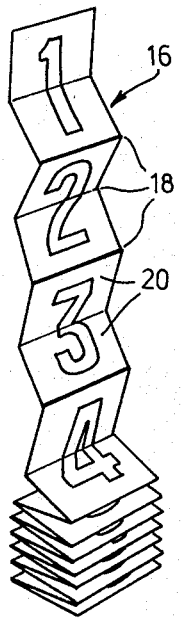
FIG. 2 is an illustration of a series of panels.

The display housing 10 has a bar 26 that supports the fold line 18 as illustrated in FIGS. 1 and 3.

As shown in FIG. 3 the free edges of the stacks 22 and 24 are retained in channels 28 and 30 respectively. The plane of the upper edge of the bar 26 is lower than the plane containing the outer extremities of the retaining channels 28 and 30 when the upper display panels 20 are retained in the retaining channels.

Figure 5:
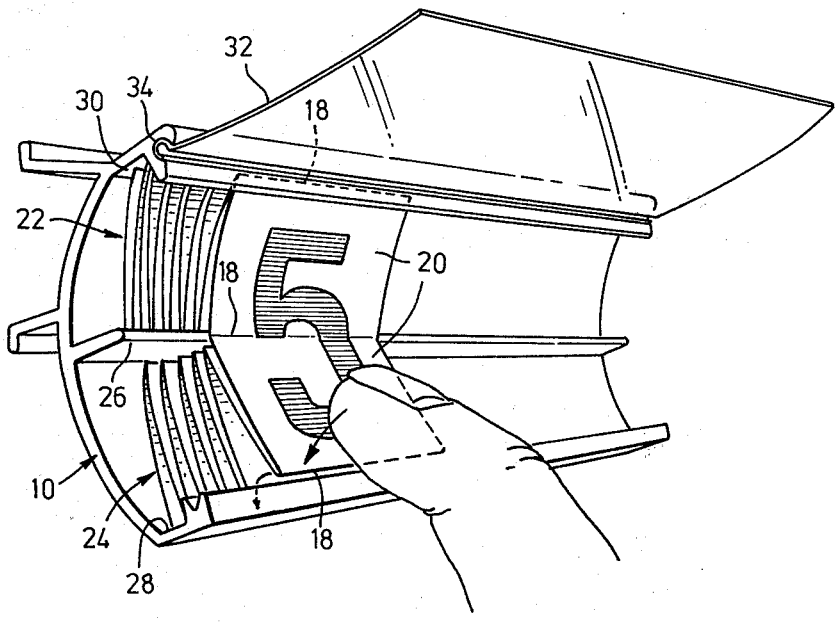

As shown it is the reading matter of two adjacent panels 20 that constitute the full display and when it is desired to change the display in the device one merely manipulates the strip within the housing to change the panels that are visible. This is done by depressing one of the panels 20 to push its fold downwardly of the upper edge of the bar 26 to pull the top panel of the upper stack from the channel 30 as illustrated in FIG. 5 an then tucking the free edge of the panels so released under retaining channel 28 to display a different number as illustrated in FIG. 5. In the illustration of these figures the display has been changed from numeral 6 to numeral 5. In a similar way any numeral can be displayed.

One can provide a plastics cover for the display strip to protect the display strip and also to discourage unauthorized tampering with the displayed information. This strip merely comprises a strip of flexible plastics transparent material 32 hinged in the casing as at 34 and resilient so that the free edge thereof can be snapped into the retaining channel 36.

Figure 4:
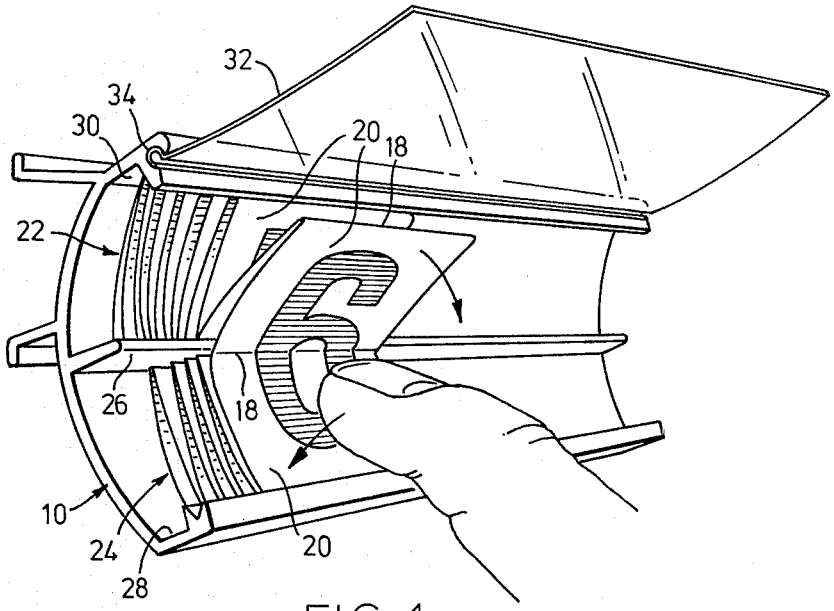
FIGS. 4 and 5 are illustrations showing the manner in which the stacks are manipulated to change the display materials.

In use the display device is mounted on a grocery or like retailing shelf as illustrated in FIG. 1 and the stacks of panels are inserted into the housing as illustrated in FIG. 3. The retailer manipulates the panels of the two stacks into which the panels 20 are formed by depressing one of the top panels 20 to carry the fold line between it and its adjacent panel downwardly of one side of the support bar 26 as illustrated in FIG. 4 and to pull the opposite panel from the retainer 30 as illustrated in FIG. 4. In this case the top panel of each of the stacks combines to display the numeral 6 as illustrated in FIG.

4. To achieve the numeral 5 one takes the top panel with its underlying panel that has been released from the retainer 30 and inserts it into retainer 28 as illustrated in FIG. 5 to display two panels which show the numeral 5. If the device is to be used for pricing the strip has panels with each of the digits from 0 to 9 whereby to permit full flexibility in respect of pricing. Any other information could be contained on the panels. The idea is to provide for changing information by displaying information on any two adjacent panels at will. This is done by supporting them as indicated and manipulating the edges from one retaining means and flexing it into the other retaining means whereby to display two different panels. It will be noted that the edges of the panels opposite the ones that are in the retaining means have sufficient space to separate so that there is a distance below the support means 26 into which one can project the top panel of one or other stack to change the display. There is room to pull one of the stacks from its retaining means as the top panel is depressed over the edge of the support bar 26.

As noted above the plane of the upper edge of the bar 26 is lower than the plane containing the outer extremities of the retaining chambers 28 and 30 and the height of the support bar is greater than the depth of the retainer channels. This disposition permits the relaxed stacking of the panels in each of the stacks 22 and 24; urges the fold line 18 between the top panel 20 of each of the stacks against the support 26 and facilitates the snapping out of the top panel 20 of one of the stacks as illustrated in FIG. 4. A triangle between the upper edge of each channel and the top of bar 26 taken in a plane transversely of the body 10 will have upper angles of about 20 degrees plus or minus two or three degrees for best results in the commonly used sizes of the display device. The actual dimensions of the triangle for best results may vary with the resistance of the material of the panels to flexing and the overall size of the display device but a person skilled in the art could select the sizing to achieve the foregoing objects.

Insofar as the relaxed stacking of the panels is concerned, it will be apparent that the bar 26 has transverse thickness and that the fold line 18 between the top panels 20 of the two stacks 22 and 24 rests on the top median line of the bar 26. The panels underlying the top panels would have to be flexed by a distance equal to $\frac{1}{2}$ the thickness of the bar if the top of the channel were of the same height as the bar. By raising the channels with respect to the bar one provides room to relieve the flexing that would otherwise be caused if the top of the retainer channels and the top of the support bar were on the same level.

It will be apparent that the raised channels also serve to urge the fold line 18 of the top panels 20 against the bar 26 to maintain the top panels firmly positioned in display position and to facilitate the snapping out action as noted above.

Embodiments of the invention other than the one illustrated will be apparent to those skilled in the art and it is not intended that the invention should be restricted to the specific embodiment illustrated.

What I claim as my invention is:

1. A display device comprising:

a strip of flexible sheet material formed with a series of transverse folds to divide it into panels of equal size, the panels being arranged in two stacks, the top panel of each stack being adjacent panels joined at the fold line between them;

a housing for said panels having two retainer channels the outside edge of one of said stacks being contained by one retainer channel and the outside edge of the other of said stacks being contained by the other of said channels;

said housing having a support bar between said retainer channels underlying said fold line between the top panel of each of said stacks;

said retainer channels being spaced to hold the top panels of each stack with said fold line between the top panel of each of said stacks against said support whereby to present the top panels to open view;

said support bar having a height greater than the edge thickness of the stack of panels beneath it and greater than the depth of said retainer channels; the plane of the upper edge of the retainer channels being spaced above the upper edge of said support bar whereby to relax the panels in said stacks and urge the fold line between the top panel of each of the stacks against said support bar and provide for the manual manipulation of the top panel in one stack to move said fold line between the top panel of both stacks from the support a distance to pull the top panel of the other stack from its retainer channel, said top panel so removed from one retainer channel being insertable in the other retainer channel to display two different panels of said strip as top panels to open view;

said panels having display materials thereon, the display materials being visible when they are top panels in said stacks in said housing and in open view as aforesaid.

* * * * *